US006390196B1

(12) United States Patent
Montaron et al.

(10) Patent No.: US 6,390,196 B1
(45) Date of Patent: May 21, 2002

(54) METHOD AND APPARATUS FOR COMPLETING A WELL FOR PRODUCING HYDROCARBONS OR THE LIKE

(75) Inventors: Bernard Montaron, Dubai (AE); Joel Rondeau, Antony (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 09/539,071

(22) Filed: Mar. 30, 2000

(30) Foreign Application Priority Data

Mar. 31, 1999 (FR) ..... 99 04301

(51) Int. Cl.[7] ..... E21B 33/13
(52) U.S. Cl. ..... 166/290; 166/177.4; 166/285
(58) Field of Search ..... 166/177.4, 290, 166/285, 321, 277

(56) References Cited

U.S. PATENT DOCUMENTS 2,274,756 A * 3/1942 Travers, Jr. ..... 166/129
2,642,141 A 6/1953 Kolb
2,888,078 A * 5/1959 Lebourg ..... 166/290
2,986,212 A 5/1961 Schultz
4,340,427 A 7/1982 Sutton
5,180,012 A * 1/1993 Crawford ..... 166/301
5,697,441 A 12/1997 Vercaemer et al.
5,718,288 A * 2/1998 Bertet et al. ..... 166/287
5,803,177 A 9/1998 Hriscu et al.

FOREIGN PATENT DOCUMENTS

FR 2290616 11/1974

* cited by examiner

*Primary Examiner*—Hoang Dang
(74) *Attorney, Agent, or Firm*—Robin C. Nava; Stephen F. Schlather; Thomas O. Mitchell

(57) ABSTRACT

The invention provides a method of isolating an open hole fitted with a slotted liner, the method consisting in pumping a cement or a resin to the level of the slotted liner by means of injection apparatus provided with lips for scrapping the slotted liner downstream from the injection point so that the cement or resin fills the entire borehole upstream from the injection apparatus and also fills the space behind the slotted liner while the apparatus is being raised towards the surface. The invention also provides injection apparatus particularly adapted to implement the method, which apparatus can advantageously be displaced by means of coiled tubing.

12 Claims, 2 Drawing Sheets

METHOD AND APPARATUS FOR COMPLETING A WELL FOR PRODUCING HYDROCARBONS OR THE LIKE

The present invention relates to the field of oil and related services, and more precisely to completing wells for producing hydrocarbons, geothermal wells, or the like.

BACKGROUND OF THE INVENTION

The conventional practice in the oil industry consists in fitting the well with a metal lining which is generally known as "casing", which casing is lowered down the hole and then fixed by means of cement that is placed in the annular gap between the casing and the wall of the hole. Lining the well in this way serves to prevent the walls from collapsing and also serves to isolate the various geological strata so as to avoid fluids being exchanged between them.

The casing can extend into the production zone. Under such circumstances, perforations are made through the casing and the cemented zone so as to allow fluids to flow from the formation into the well. If some of the perforations begin to produce increasing quantities of water or gas, e.g. due to the reservoir aging, it is relatively easy to plug them and to proceed with making new perforations in zones that are more favorable.

Although lining is highly advantageous in the medium or long term, it suffers in the short term from being relatively expensive, from delaying the start of production, and from limiting initial production since fluid can penetrate into the well only via the perforations and not through the entire periphery of the well where it passes through the production zone. This point is particularly critical in so-called "horizontal" wells, i.e. wells that are typically deviated by more than 25° from the vertical, with the main justification for so doing being to increase the interface area between the well and the production zone.

That is why many wells, and in particular a large proportion of horizontal wells, are left open in the hydrocarbon production zone. When the formations are poorly consolidated, the walls are prevented from collapsing by a slotted liner which is merely put into place (i.e. without any cement in the annular gap).

However, as the reservoir ages, the need to control ingress of water (or gas) into the well becomes more and more critical. Unfortunately, this problem is made even more difficult to solve by the entry point of the undesired fluid into the well being difficult to locate, as is usually the case. The fluid can flow behind the slotted liner over a long distance before actually emerging in the well. Depending on the shape of the well, the entry points can be upstream or even downstream from the apparent entry point.

Independently of that difficulty in locating the source of fluid, there are few effective means for plugging such leaks. In general, the means available consist in isolating the zone to be treated by means of packers and in injecting a consolidating fluid (resin or cement) into the treated zone. U.S. Pat. No. 5,339,901 and U.S. Pat. No. 5,697,441 give examples of such techniques known in the prior art. Those techniques are satisfactory for isolating the end of a well, with the zone upstream from the plug being abandoned, however they do not make it possible to guarantee that cement is placed behind an extended length of liner as is necessary if production zones are to be found upstream from the zone that is to be treated.

Another solution consists in putting a closed liner into place and then expanding it closer to the walls of the well.

Such a liner, made of composite material, plastic or metal, can then be cemented using traditional techniques. Depending on circumstances, the slotted liner is left in place or is withdrawn. The cost of such techniques is particularly high because of the cost of the liner itself and because of the techniques used for putting it into place, and in particular for expanding it.

SUMMARY OF THE INVENTION

An object of the present invention is to provide a novel method of reestablishing isolation between zones of an open hole provided with a slotted liner, in particular a borehole for exploiting a deposit of hydrocarbons, gas, water, or the like, the method consisting in pumping an isolation material from the surface to injection apparatus while providing sealing along the slotted liner downstream from the point at which the isolation material is injected so that the isolation material fills the borehole upstream from the injection apparatus together with the space behind the slotted liner, and in raising the injection apparatus towards the surface. "Upstream" and "downstream" are defined relative to the flow of hydrocarbon, so upstream is thus a point that is closer to the surface.

The method of the invention avoids using a closed liner and the injection zone is at all times relatively small which means that it is possible to ensure that the isolation material penetrates effectively behind the slotted liner, expelling the fluids present towards the surface of the well.

The isolation material can be a resin that polymerizes after being put into place, or a cement, in particular a thixotropic cement such as a foam cement in particular. Foams based on microcement are particularly preferred, i.e. on cement in which the maximum particle size lies in the range 6 $\mu$m to 12 $\mu$m, and preferably in the range 8 $\mu$m to 11 $\mu$m, with the median particle diameter being a few microns, typically 4 $\mu$m for commercial microcements, and having a specific surface area per unit weight determined by the air permeability test (Blaine fineness) in excess of 0.6 $m^2/g$, preferably greater than 0.7 $m^2/g$, and more preferably close to 0.8 $m^2/g$.

The invention also provides injection apparatus particularly adapted to implementing the method of the invention and comprising: a hollow tubular body whose outer wall includes at least one ring forming a prestressed sealing gasket and a piston engaged around the tubular body and capable of being displaced along the tubular body between a rest position in which the piston compresses the prestressed sealing gasket and prevents any flow of isolation material from the injection apparatus, and an open position in which the prestressed sealing gasket is disengaged to come into contact with the slotted liner and the isolation material can flow out from the injection apparatus.

In a particularly preferred variant of the invention, the apparatus is moved by means of coiled tubing, and after cementing, the hole is rebored to the inside diameter of the slotted liner using a boring tool that is likewise mounted at the end of coiled tubing.

Other advantageous characteristics and details of the invention appear from the following description given with reference to the figures.

BRIEF DESCRIPTION OF THE DRAWINGS

FIG. 1 shows an example of a so-called "open" well. In the case shown, the well is substantially horizontal in the production zone so as to improve drainage of fluid from the formation. Nevertheless, the invention is just as applicable to so-called "vertical" wells as it is to "horizontal" wells.

DETAILED DESCRIPTION OF THE INVENTION

In the production zone, the well has a slotted liner 1 merely put into place therein and which allows the fluids to flow freely towards the production tube. In poorly consolidated formations, in particular in sandy formations, a screen, e.g. made of gravel held back by a grid, is usually placed behind the slotted liner to filter the fluid from the formation and to limit the amount of sand entrained with the production fluids. Since the production zone extends over a length of several tens of meters, it may pass through zones that produce fluids that are not desired, in particular water. The water 2 can flow behind the slotted liner and reappear upstream or downstream from the point where it infiltrates into the well, thus making it very difficult to locate such infiltration points. In addition, when all or some of the infiltration points are situated downstream from the hydrocarbon-producing zones 3, it is not possible merely to abandon the downstream portion of the well since that would also be abandoning exploitation of the production zones.

The invention seeks to fill the entire zone of the well that is fitted with a slotted liner by means of a device that serves to put an isolating fluid (generally cement) into place behind the slotted liner so as to avoid any fluid circulation behind the liner. The hole is then rebored to the inside diameter of the liner and perforation can then be performed in the hydrocarbon-producing zones.

Figure 1:
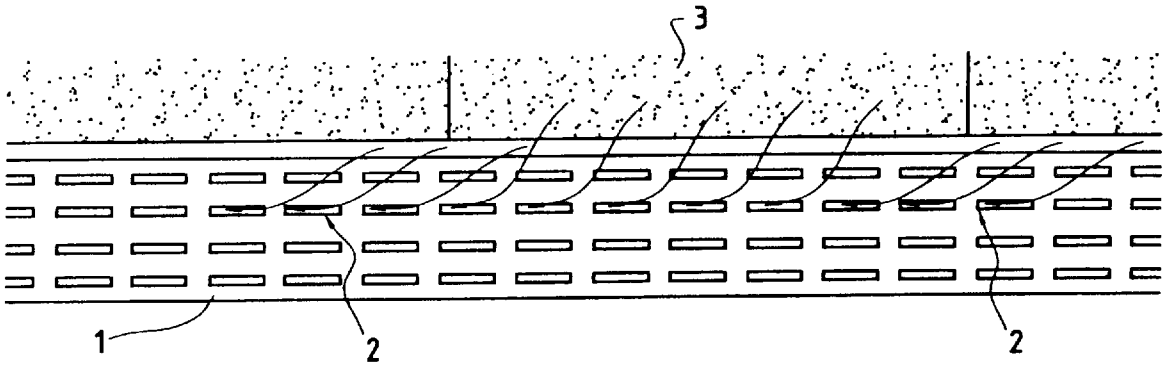
FIG. 1 is a diagrammatic view of a well provided with a slotted liner in its production zone.
Figure 2A:
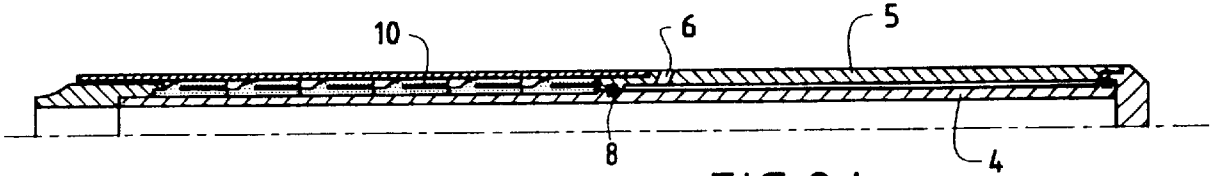
FIGS. 2*a* and 2*b* are a diagrammatic view of injection apparatus of the invention shown in the closed position (FIG. 2*a*) and in the open position (FIG. 2*b*)
Figure 2B:
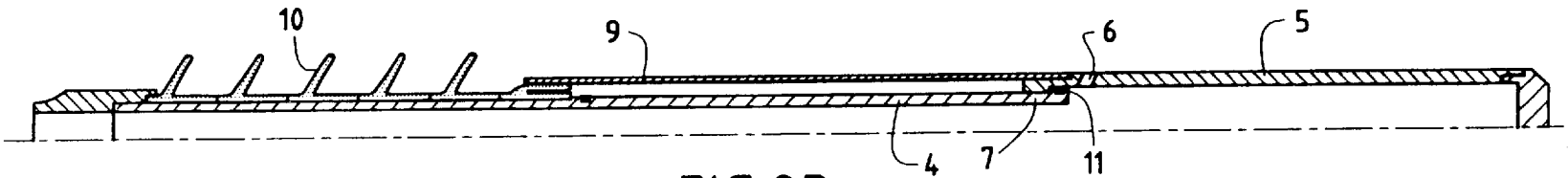

Placement is preferably performed using injection apparatus as shown diagrammatically in FIGS. 2*a*–2*b*. The apparatus essentially comprises a hollow tubular body 4 and a piston 5 of diameter that is slightly greater than the diameter of the tubular body 4 along which it can slide.

The piston 5 has a front portion fitted with at least one injection port 6, and preferably a minimum of at least four ports disposed at 90° intervals, and a rear portion separated from the front portion by a swelling 7 provided with a housing for a shear pin 8. The rear portion co-operates with the tubular body to form a basket 9.

The tubular body 4 has deformable peripheral lips 10 with the ability to be folded to smaller than a minimum outside diameter corresponding to engagement under elastic stress inside the basket, and the ability to deploy elastically so as to present an outside diameter greater than the inside diameter of the slotted liner so as to perform the function of sealing segments and tracing segments during the cementing operation.

The axial spacing between two peripheral lips is at least substantially equal to the radial extent of each lip. Each lip has a section that tapers progressively from its root towards its peripheral edge which, in the rest state (FIG. 2*b*), defines a diameter D which is greater than the inside diameter of the slotted liner. In general the diameter D lies in the range 103% to 120% the inside diameter of the slotted liner.

These lips are preferably made of elastomer having hardness on the Shore scale lying between 50 and 70. They can also be made out of composite materials, e.g. reinforced rubbers.

In the example shown diagrammatically herein, the lips are all mounted on respective rings engaged under stress one in another in a housing of the tubular body. They can equally well be fixed by any other means on the tubular body, in particular by means of clamps, or indeed they can form integral parts of said tubular body, although this latter variant is not preferred insofar as the lips are wear pieces that need replacing, as a general rule after each operation in a well. It is also possible to use a single ring carrying a plurality of lips.

The end of the tubular body also forms a shoulder 11 which, when the piston is in the closed position, co-operates with a groove formed in the front portion of the piston to ensure that the closed position is properly defined.

The shoulder 11 is permanently in contact with the piston against which it rubs so as to prevent any return flow of cement via the gap between the piston and the tubular body. It is important to control head losses while the cement is being delivered so that the pressure of the cement causes the piston to open until the injection ports are disengaged.

The shoulder 11 also co-operates with the swelling between the front and rear portions of the piston to define an abutment position which determines the maximally open position of the piston.

The length of the basket is such that when the piston is in its maximally deployed position, at least one peripheral lip remains folded and engaged in the basket, while at least one other peripheral lip is deployed. The peripheral lip that is permanently engaged in the basket provides sealing between the basket and the rear portion of the piston. In a variant of the invention, this function can be provided by a specific gasket distinct from the peripheral lip for scraping the slotted liner.

Figure 3A:
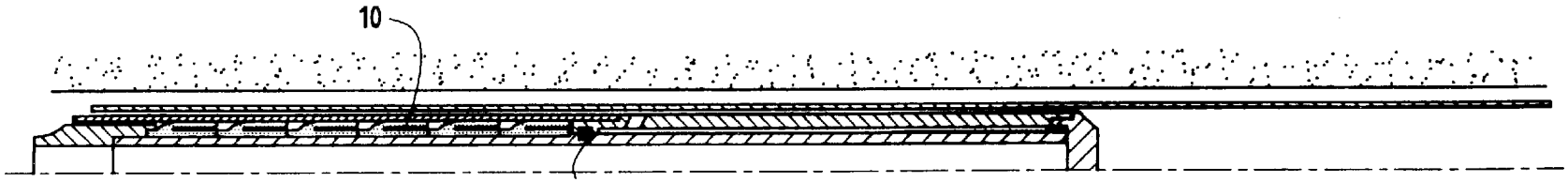
FIGS. 3*a* to 3*c* are diagrams showing steps in the method of the invention: positioning the tool (FIG. 3*a*), pumping the cement and opening the piston (FIG. 3*b*), and cementing stage (FIG. 3*c*).
Figure 3B:
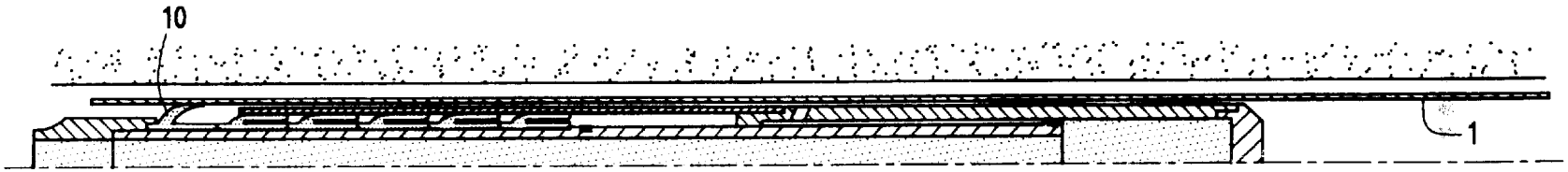
Figure 3C:
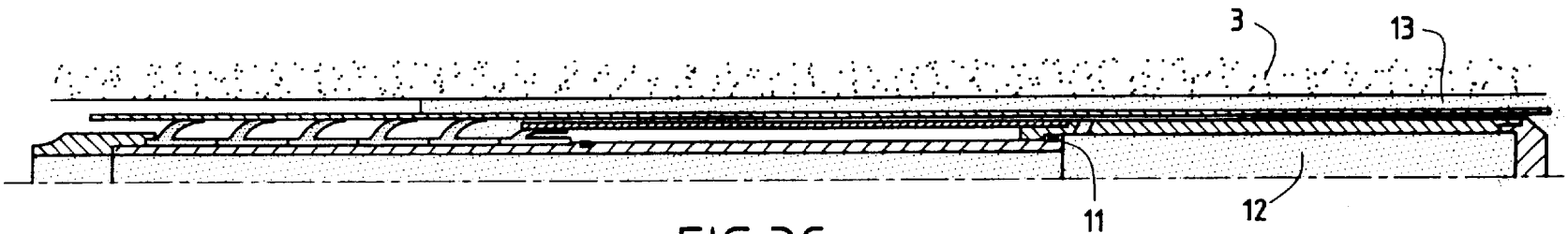

Operation is described with reference to FIGS. 3*a* to 3*c*. The injection apparatus is connected to coiled tubing or to the end of a drill string by means of a coupling not shown in the figures. The assembly is lowered down the well to the level of the slotted liner to be treated which as a general rule is situated at the bottom of the well. If this zone is not situated in the immediate vicinity of the bottom, the placement operation is preceded by placing a plug of cement that is to serve as a temporary bottom for the well. It should be observed that the cementing operation is advantageously preceded by flushing using a cleaning fluid which scrubs the slots in the liner. Such flushing is commonly performed to facilitate the passage of fluids.

In general, the apparatus is brought into contact with the bottom and is then retracted over a length that corresponds to the expansion of the piston. At the end of the stage during which the injection apparatus is positioned (FIG. 3*a*), cement 12 (or any other sealing material) begins to be pumped via the coiled tubing or the drill string so as to fill the inside of the tubular body. The internal pressure exerted by the cement then reaches the threshold pressure for unlocking the shear pin, thereby releasing the piston (FIG. 3*b*) until the swelling on the piston comes into abutment against the peripheral shoulder of the tubular body, the fully open position of the piston in which the injection ports are disengaged and at least one peripheral lip, and preferably at least two peripheral lips are deployed and come into contact with the slotted liner (FIG. 3*c*).

With continued pumping of cement from the surface, the cement fills the end of the borehole and the annular gap between the piston and the first deployed peripheral lip, and because of the isolation provided by said lip, the cement is constrained to penetrate through the slots in the liner so as to fill the annular gap 13 between the wall of the hole and the back of the liner. It should be observed that the shape of the peripheral lip is such that the cement which comes into contact with the first deployed peripheral lip exerts pressure thereon tending to press said lip even harder against the wall of the slotted liner.

The injection apparatus is raised continuously while the cement is being pumped. Naturally, the rate at which the apparatus is raised and the rate at which cement is pumped are adjusted to levels such that the inside volume of the hole is filled completely.

When all or part of the slotted liner has been cemented, the pumping of cement is stopped and it is possible, for example, to pump drilling fluid so as to enable the injection apparatus to be cleaned before the cement sets. The injection apparatus is then raised to the surface and the cement is allowed to set.

Once the cement has set, a drilling tool is lowered down the well in order to remove all the cement that has set inside the slotted liner. This drilling tool is preferably mounted at the end of coiled tubing, using the coiled tubing drilling technique. It is also possible to use a drilling tool of the underreamer type that is small enough to pass through the production tube. The well is then ready for perforation.

It should be observed that the use of coiled tubing makes it possible to work while leaving the production tube in place, with the production tube merely being raised by a length that is sufficient to avoid it being cemented.

The use of a foam cement as the isolation material is particularly preferred since this type of cement has good thixotropic characteristics, thereby facilitating its penetration through the slots of the liner. Furthermore, it is possible to make cements that are very lightweight and therefore do not run the risk of undesirably fracturing the formations, and they are particularly easy to redrill. Foam cement also makes it possible to adjust its density by varying the quantity of nitrogen so as to match exactly the density of the mud in the hole, thereby ensuring that the cement neither "sinks" nor "floats", thus making it possible to fill all of the cavity.

What is claimed is:

1. Apparatus for injecting an isolation material in an open hole provided with a slotted liner, the apparatus comprising:

a hollow tubular body whose outside wall has at least one peripheral annular lip that is elastically deformable to form a prestressed sealing gasket;

a piston engaged around the tubular body and capable of being displaced along the tubular body between:

a rest position in which the piston compresses the prestressed sealing gasket and prevents any flow of isolation material from the injection apparatus; and an open position in which the prestressed sealing gasket is disengaged to come into contact with the slotted liner, and the isolation material can flow out from the injection apparatus.

2. An injection apparatus according to claim 1, characterized in that the piston has at least one injection port that is closed in the rest position.

3. An injection apparatus according to claim 2, characterized in that it further includes a sealing lip in contact between the outside wall of the tubular body and the piston to prevent isolation material accumulating between the piston and the tubular body.

4. An injection apparatus according to claim 3, characterized in that it further includes a shear pin to release the piston when the pressure exerted by the isolation material exceeds a certain threshold.

5. An injection apparatus according to claim 2, characterized in that it further includes a shear pin to release the piston when the pressure exerted by the isolation material exceeds a certain threshold.

6. An injection apparatus according to claim 3, characterized in that it further includes a shear pin to release the piston when the pressure exerted by the isolation material exceeds a certain threshold.

7. A tool for placing isolation material in an open hole fitted with a slotted liner, the tool comprising:

a coiled tubing, an injection for injecting an isolation material in an open hole provided with a slotted liner, the apparatus comprising:

a hollow tubular body whose outside wall has at least one peripheral annular lip that is elastically deformable to form a prestressed sealing gasket;

a piston engaged around the tubular body and capable of being displaced along the tubular body between:

a rest position in which the piston compresses the prestressed sealing gasket and prevents any flow of isolation material from the injection apparatus; and an open position in which the prestressed sealing gasket is disengaged to come into contact with the slotted liner, and the isolation material can flow out from the injection apparatus; and means for connecting the injection apparatus to the end of the coiled tubing.

8. A method of isolating a zone in a borehole provided with a slotted liner, comprising:

(i) positioning an injection apparatus in the borehole near the zone to be isolated;

(ii) pumping an isolation material from the surface to the injection apparatus;

(iii) operating the injection apparatus so as to admit the isolation material into the borehole and slotted liner while providing a seal along the slotted liner downhole from the admission of the isolating fluid such that the isolating fluid fills the borehole upstream from the injection apparatus together with any space behind the slotted liner; and (iv) raising the injection apparatus towards the surface while the injection apparatus is operated.

9. A method as claimed in claim 8, further comprising pumping the isolation material to the injection apparatus via coiled tubing, and using the coiled tubing to raise the injection apparatus towards the surface as it is operated.

10. A method as claimed in claim 8, comprising pumping a resin via the injection apparatus into the borehole and slotted liner.

11. A method as claimed in claim 8, comprising pumping a cement slurry via the injection apparatus into the borehole and slotted liner.

12. A method as claimed in claim 11, comprising pumping a foamed microcement via the injection apparatus into the borehole and slotted liner.

* * * * *